US005356367A

United States Patent [19]

Carr

[11] Patent Number: 5,356,367

[45] Date of Patent: Oct. 18, 1994

[54] CENTRIFUGAL SEPARATOR WITH FLEXIBLY SUSPENDED RESTRAINABLE BOWL

[75] Inventor: Robert B. Carr, Dedham, Mass.

[73] Assignee: Carr Engineering Associates, Inc., Easton, Mass.

[21] Appl. No.: 162,781

[22] Filed: Dec. 6, 1993

Related U.S. Application Data

[63] Continuation of Ser. No. 88,605, Jul. 6, 1993, abandoned, which is a continuation of Ser. No. 803,477, Dec. 4, 1991, abandoned.

[51] Int. Cl.[5] ..... B04B 11/08; B04B 9/12

[52] U.S. Cl. ..... 494/58; 494/46; 494/83

[58] Field of Search ..... 68/233; 210/512.1, 787; 494/56, 57, 58, 59, 82, 83, 84, 85, 46; 422/270

[56] References Cited

U.S. PATENT DOCUMENTS

| | | | |
|---|---|---|---|
| 459,197 | 9/1891 | Bodge | 494/56 |
| 2,040,351 | 5/1936 | Williams | 494/83 |
| 2,094,058 | 9/1937 | Bryson | 494/83 |
| 2,172,320 | 9/1939 | Jones | 494/59 |
| 2,692,725 | 10/1954 | Hensgen | 494/59 |
| 3,056,505 | 10/1962 | Andersson | 494/56 |
| 3,306,681 | 2/1967 | Barringer | 494/82 |
| 3,366,319 | 1/1968 | Easton | 494/56 |
| 3,430,852 | 3/1969 | Lenkey | 494/84 |
| 3,779,450 | 12/1973 | Shapiro | 494/57 |
| 4,014,497 | 3/1977 | Spiewok | 494/56 |
| 4,493,768 | 1/1985 | Kubr | 494/58 |

FOREIGN PATENT DOCUMENTS

| | | | |
|---|---|---|---|
| 54303 | 2/1967 | Denmark | 494/56 |
| 152069 | 11/1981 | Denmark | 494/85 |
| 1421414 | 3/1987 | U.S.S.R. | 494/83 |

*Primary Examiner*—David A. Scherbel
*Assistant Examiner*—Terrence R. Till
*Attorney, Agent, or Firm*—Darby & Darby

[57] ABSTRACT

A centrifuge separator system includes a centrifuge bowl for receiving the feed to be separated; a flexible suspension for rotatably, flexibly supporting the bowl; and a retractable restrainer device for constraining the bowl during scraping action of a scraper blade to remove solids from the bowl. Alternatively, the bowl could be radially and rotationally constrained and the scraper rotated to remove solids from the bowl.

9 Claims, 4 Drawing Sheets

CENTRIFUGAL SEPARATOR WITH FLEXIBLY SUSPENDED RESTRAINABLE BOWL

This is a continuation, of application Ser. No. 08/088,605, filed Jul. 6, 1993, which is a continuation, of application Ser. No. 07/803,477, filed Dec. 4, 1991, now both abandoned.

FIELD OF INVENTION

This invention relates to a centrifugal separator, and more particularly to such a separator in which the bowl is flexibly suspended at high speeds above spindle critical speeds to balance the bowl load yet is rigidly constrained at lower speeds for bowl scraping.

BACKGROUND OF INVENTION

Conventional centrifuges employ flexible mounting of the spindle and bowl in order to attain high rotational speeds and yet accommodate off-balance loading and critical speed vibrations. However, the flexible mounting introduces a separate problem: the very flexibility that accommodates the off-balance loading and spindle critical-speed vibrations causes the bowl to be easily displaced and avoid the action of the scraper blade and also results in a poor and variable alignment of the blade with the bowl wall. One solution to this problem is to rigidly but rotatably mount the spindle and bowl so that the scraper blade has a precision scraping action. The rigid spindle and bowl, however, limit the speed of rotation to below the spindle critical speeds, which causes the separation efficiency to suffer.

SUMMARY OF INVENTION

It is therefore an object of this invention to provide an improved centrifuge which permits high-speed operation for superior separation yet provides a rigidly mounted bowl for scraping at low speeds.

It is a further object of this invention to provide such an improved centrifuge by utilizing a flexible suspension for the bowl and spindle at high speeds and fixing the bowl against yielding to the scraper action while maintaining alignment between the scraper blade and bowl during scraping.

It is a further object of this invention to provide such an improved centrifuge which both produces good separation and dry solids and enables efficient, automatic removal of the dry solids with a scraper blade.

The invention results from the realization that a truly effective centrifuge separation can be achieved with a flexible suspension for balancing bowl loads and permitting operation at high speeds in excess of spindle critical speeds and a device for constraining the bowl against radial motion during lower speed scraping operations.

This invention features a centrifuge separator system having a centrifuge bowl for receiving the feed to be separated. There is a flexible suspension means for rotatably flexibly supporting the bowl. Retractable restraining means constrain the bowl during scraping action of a scraper blade to remove solids from the bowl.

In a preferred embodiment, the bowl may include a spindle and the spindle and bowl are suspended by the flexible suspension means and are constrained by the restraining means. The flexible suspension means may include a spherical bearing, springs, or a resilient isolator, which may include elastomeric members. The bowl may be disposed for rotation about a vertical axis and the flexible suspension means may pendulously support the bowl. The restraining means may include a rotational bearing which constrains the bowl radially and enables rotation of the bowl relative the scraper blade. There may also be means for constraining the bowl radially and rotationally while the scraper blade rotates relative to the bowl to remove solids.

DISCLOSURE OF PREFERRED EMBODIMENT

Other objects, features and advantages will occur to those skilled in the art from the following description of a preferred embodiment and the accompanying drawings, in which.

This invention may be accomplished in a centrifugal separator system which includes a centrifuge bowl that receives the feed to be separated. There are flexible suspension means for rotatably flexibly supporting the bowl. Typically the bowl is an imperforate bowl and it includes a spindle which is flexibly suspended from the housing. The flexible suspension may be a spherical bearing or elastomeric isolators or springs sufficient to allow the rotational axis of the bowl to diverge from the vertical axis so accommodation may be made for unbalanced loads and vibrations. This enables the device to operate at high rotational speeds above the spindle critical speeds where superior efficient separation can be effected. Although generally the devices are arranged so that the bowl rotates about a vertical axis, this is not a necessary limitation of the invention. In those cases where it is so oriented the flexible suspension is in the nature of a pendulous suspension but the devices may be operated in any orientation, vertical, horizontal or otherwise. In order to accomplish the effective removal of the solids, the system includes a retractable restraining means which radially constrains the bowl during the scraping action of the scraper blade. For example there may be a conical journal mounted on the bowl which engages with a mating conical surface of a bearing. When the two are engaged, the self-centering action fixes the bowl against radial motion so that the rotational and bowl and spindle axes can no longer diverge, but the bowl can still rotate so that scraping of the solids can occur. When high-speed operation is desirable, the conical bearing may be moved away from the conical journal so that the spindle is free to reorient inside the conical surface bearing and the axis of the spindle and bowl can diverge from the axis of rotation to enable the bowl to accommodate for unbalanced loads. When the device includes a rotatable scraper blade, then the restraining device may restrain the bowl and/or spindle against rotational motion as well as radial motion so that the bowl is completely fixed and the blade rotates to scrape the solids from the inside of the bowl.

Figure 1:
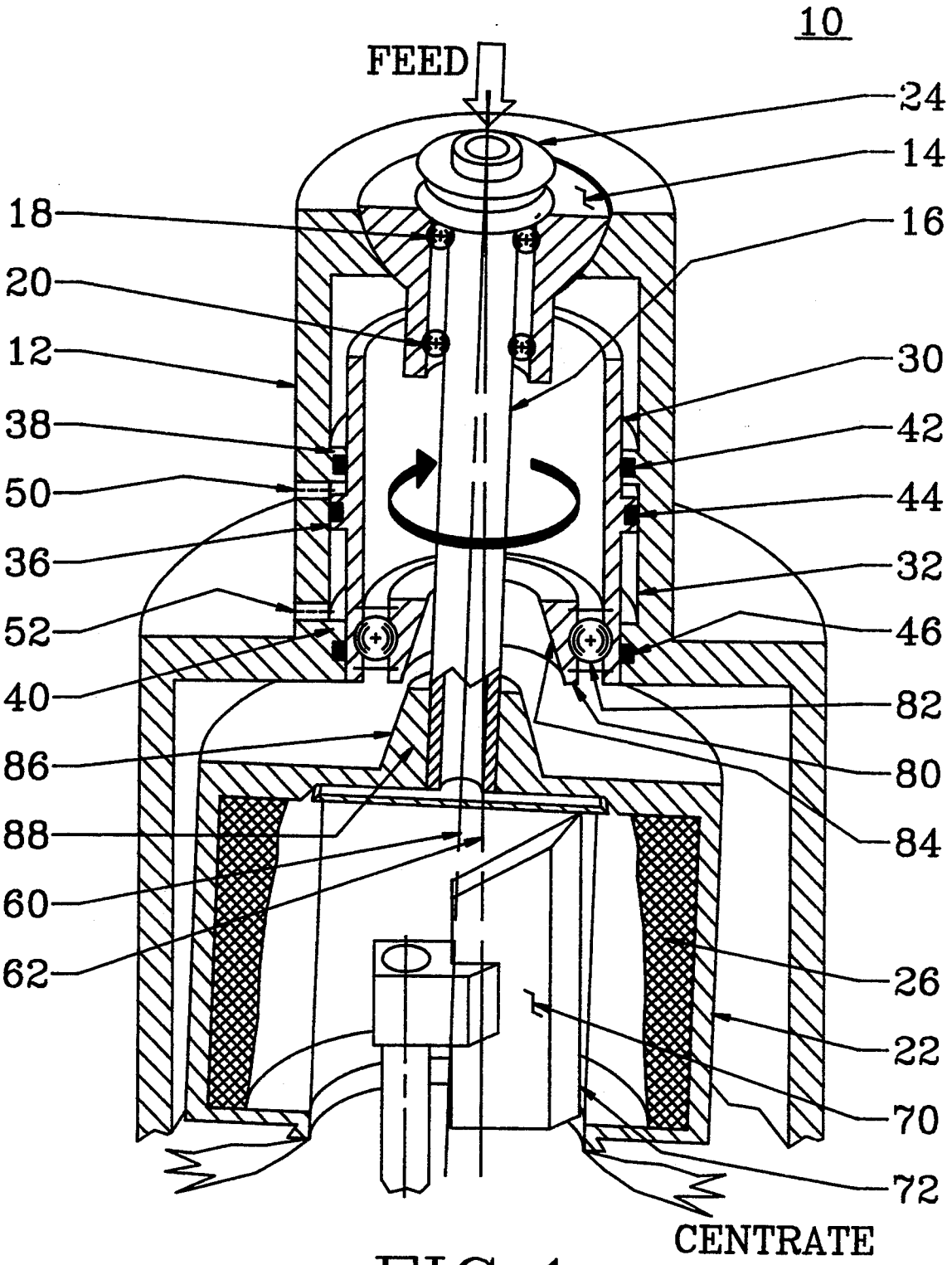
FIG. 1 is a simplified diagrammatic cross-sectional view of a portion of the centrifugal separator according to this invention with the bowl flexibly suspended to accommodate high-speed off balance operation.

There is shown in FIG. 1 a centrifugal separator 10 according to this invention including a housing 12 in which is mounted a spherical bearing 14. Spherical bearing 14 flexibly supports spindle 16 which may be hollow and which is rotatably mounted by means of bearings 18 and 20. Spindle 16 extends as a portion of bowl 22. Spindle 16 and bowl 22 are rotated by a suitable drive mechanism such as a belt, not shown, which engages with pulley 24 at the top of spindle 16. Feed may be delivered through hollow spindle 16 or other means into bowl 22, where the centrifugal action drives the solids 26 toward the inner circumference of bowl 22. Locking piston 30 is slidably received in cylinder 32 of housing 12. Circumferential rim 36 limits the vertical motion of piston 30 by its contact with circumferential shoulder 38 at the top and flange 40 at the bottom of cylinder 32. "0" rings 42, 44 and 46 or other suitable sealing means are provided between cylinder 32 and piston 30. Piston 30 may be moved up and down within the limits established by shoulder 38 and flange 40 by air pressure or hydraulic pressure through ports 50 and 52 or by mechanical means.

In operation, spindle 16 and bowl 22 are free to rotate at very high speeds in order to perform efficient, superior separation of solids 26. The speed of rotation can exceed spindle critical speeds since the flexible mounting afforded by spherical bearing 14 permits the bowl 22 to swing so that the spindle and bowl axis 60 diverges from the axis of rotation 62 in order to compensate for any load unbalance of the feed or solids in bowl 22. During this period scraper blade 70 remains immobile. As can be seen in FIG. 1, the scraping surface 72 of scraper blade 70 is not parallel during the condition when spindle and bowl axis 60 is divergent from the axis of spin 62. Any attempt to scrape the solids while the bowl is so loosely suspended would result in an incomplete removal of solids and excessive wear or even damage to the blade and bowl.

Figure 2:
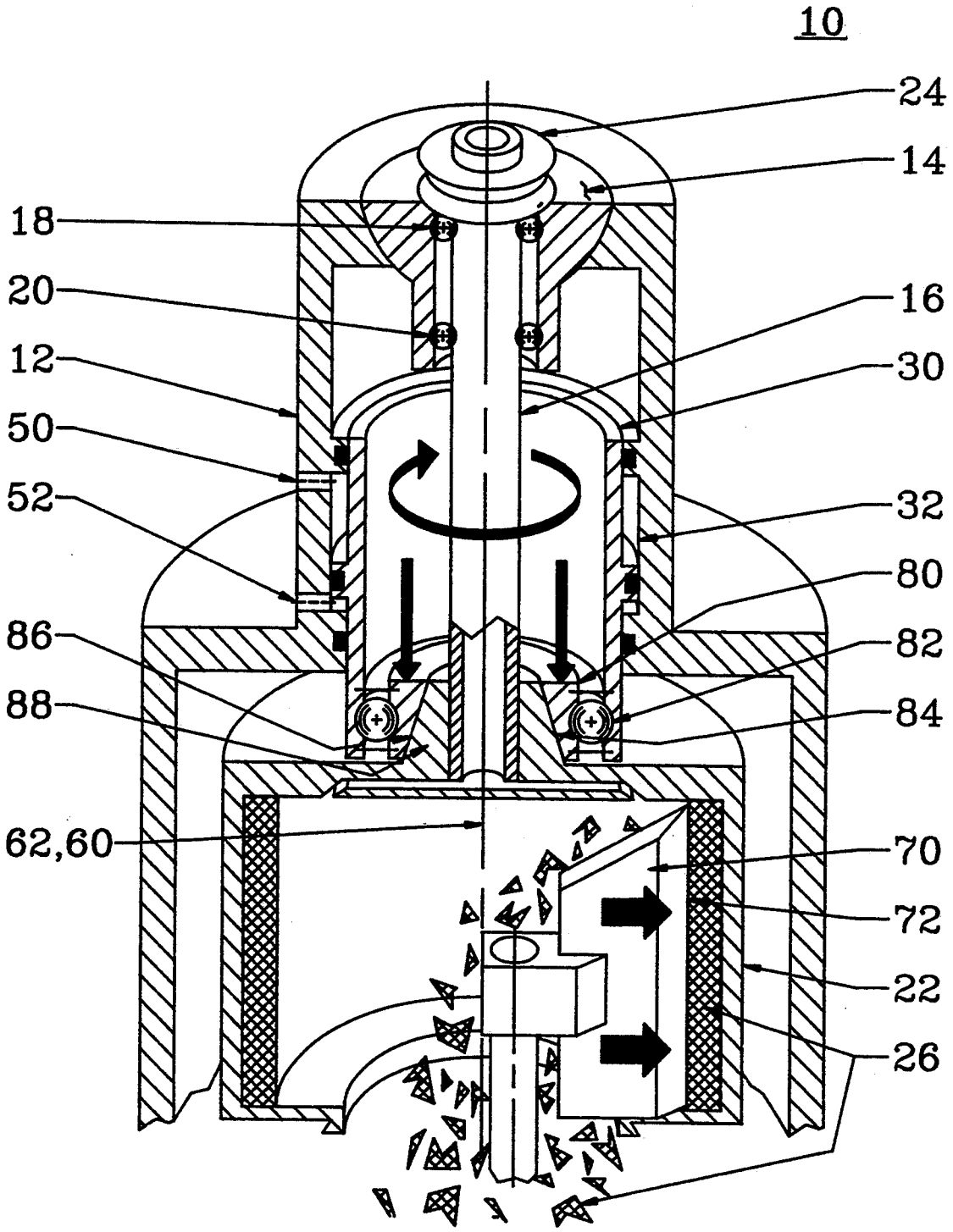
FIG. 2 is a view similar to FIG. 1 with the bowl radially restrained and operating at low speed for removal of separated solids by means of a scraper blade.

To accommodate this, piston 30 may be actuated to move downwards in cylinder 32 as shown in FIG. 2. At the base of cylinder 30 is locking bearing 80 which is rotationally supported by bearings 82 and contains a conical surface 84 which mates with the conical surface 86 of journal 88.

When piston 30 is moved down in cylinder 32, locking bearing 80 moves down with piston 30 so that its conical surface 84 engages the mating conical surface 86 of journal 88. This radially constrains spindle 16 and bowl 22 so that its axis 60 is coincident with the vertical axis 62 of the separator. This provides a rigid support for bowl 22, yet permits bowl 22 along with spindle 16 to rotate at low speed so that scraper 70 can be moved to engage the solids 26 and break them away from the bowl for discharge. The discharge arrangement is explained in greater detail in a copending application U.S. Ser. No. 07/803,475 entitled "Imperforate Bowl Centrifugal Separator With Solids Gate" by the same inventor, Robert B. Carr, filed on even date herewith, and incorporated herein by reference. With bowl 22 rigidly held, the surface 72 of blade 70 can be maintained in alignment with the wall of bowl 22 so that wear is reduced and the possibility of damage is eliminated.

Although a spherical bearing is shown as a means for suspending bowl 22, this is not a necessary limitation of the invention. Any number of different suspension devices may be used. Suspension device 14*a*, FIG. 3, includes an annular shoulder 96 on housing 12*a* which supports bearing block 94 on springs 92. Resilient centering forces are applied to bearing block 94 by springs 90. Suspension device 14*a* provides the same sort of flexible suspension, allowing the rotation axis to diverge from the vertical axis, as was afforded by spherical bearing 14 in FIG. 1.

Figure 3:
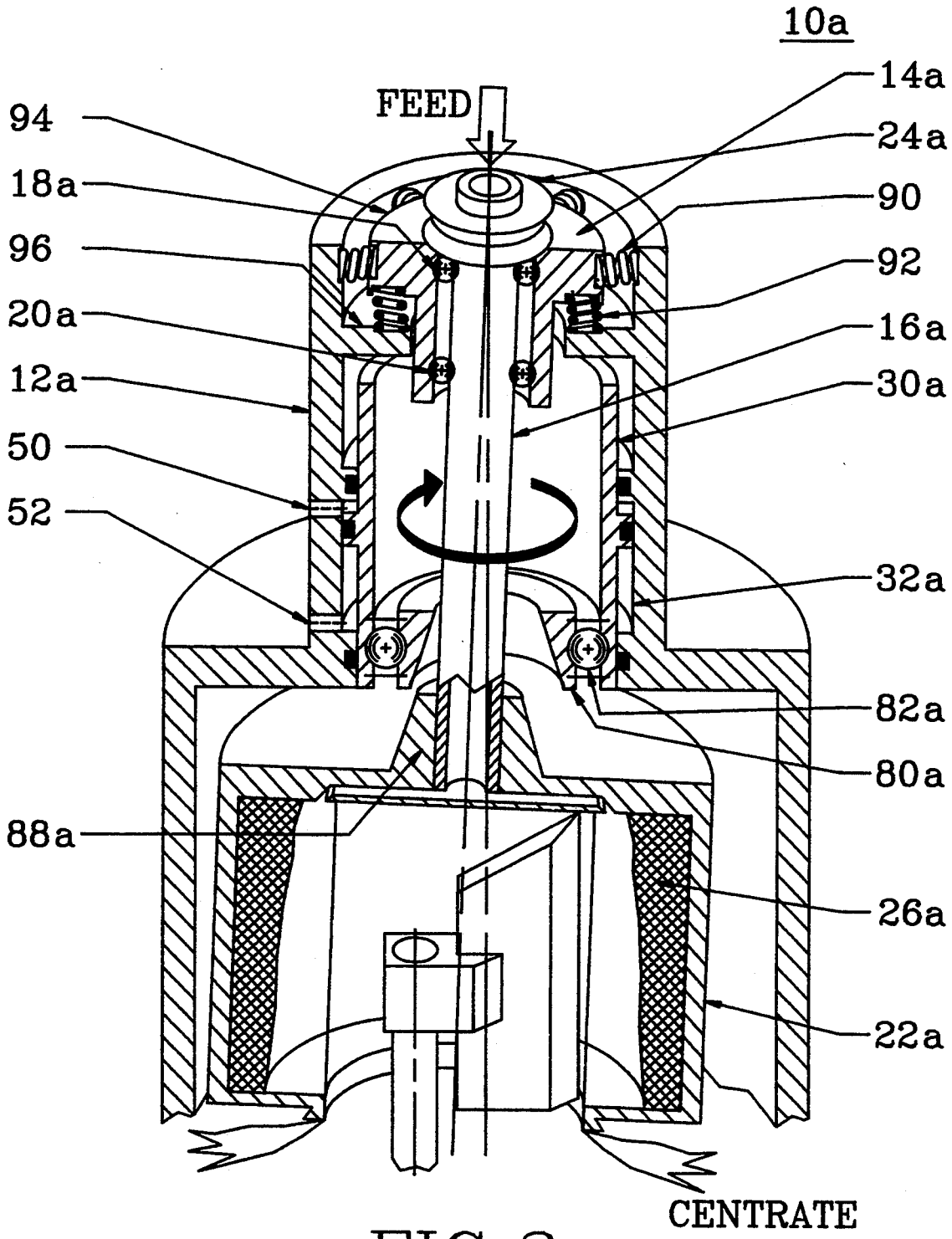
FIG. 3 is a view similar to that in FIG. 1 showing an alternative form of suspension means.

Although thus far in FIGS. 1–3 the spherical bearing 14 and flexible suspension device 14*a* are shown as pendulously supporting bowls 22 and 22*a*, respectively, this is not a necessary limitation of the invention. The device may be mounted in any orientation so that a gravity referenced pendulous arrangement is not compelled.

Figure 4:
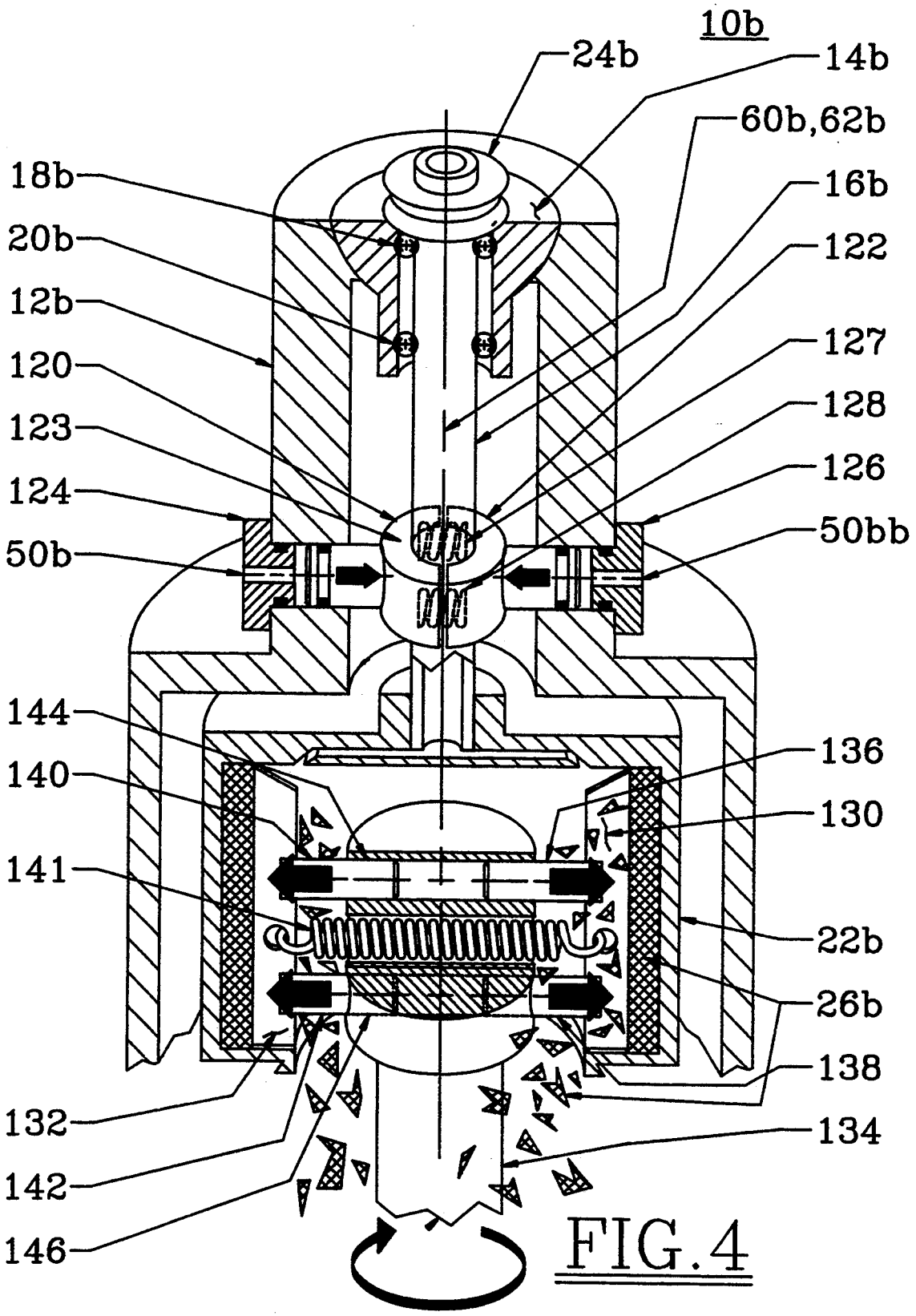
FIG. 4 is a view similar to FIG. 1 wherein the bowl is restrained both radially and rotationally and the scraper blade rotates.

In FIG. 2 bowl 22 is restrained only radially, and is permitted to continue rotating to allow the fixed scraper blade 70 to remove the solids 26, but this is not a necessary limitation of the invention. In FIG. 4, spindle 16*b* may include locking yokes 120 and 122 which are urged apart by springs 127, 128. End caps 124, 126 of yokes 120, 122 are adapted to connect to a source of air pressure which when applied through ports 50*b* and 50*bb* drives yokes 120, 122 to engage spindle 16*b* against the urging of springs 127, 128. Yokes 120, 122 when engaged against spindle 16*b* not only force rotational axis 60*b* to coincide with vertical axis 62*b*, but also prevent rotation of spindle 16*b* and bowl 22*b*. In this construction two scraper elements 130, 132, are mounted on shaft 134. Blade 130 may be formed of a pair of tabs 136, 138, and blade 132 may be formed of similar tabs 140 and 142 with integral pins which are slidably received in bores 144 and 146. The centrifugal force created by the rotation of shaft 134 causes blades 130 and 132 to ride radially outwardly against the restraint of spring 141. Their respective pins 136, 138 and 140, 142 slide in bores 144 and 146. The edges of blades 130, 132 thereby are kept in contact with the solids 26*b* and scrape them off as shaft 134 rotates.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A centrifugal separator system for separating a feed material at a high speed, comprising:

a rotatable centrifuge bowl having an interior surface for receiving said feed material;

a flexible suspension means for rotatably, flexibly supporting said bowl;

a scraper blade to remove solids from said interior surface of said bowl during low speed revolutions; and retractable substantially radially rigid restraining means for constraining said bowl during low speed revolutions such that the distance between said scraper blade and said interior surface remains substantially constant.

2. The centrifuge separation system of claim 1 in which said bowl includes a spindle.

3. The centrifuge separation system of claim 2 in which said spindle and bowl are suspended by said flexible suspension means.

4. The centrifuge separation system of claim 2 in which said bowl is radially constrained by said restraining means.

5. The centrifuge separation system of claim 1, wherein said flexible suspension means comprises a semi-spherical includes a spherical bearing.

6. The centrifuge separation system of claim 1, wherein said bowl rotates about a vertical axis and said flexible suspension means pendulously supports said bowl.

7. The centrifuge separation system of claim 1 in which said restraining means includes a rotational bearing which constrains said bowl radially and enables rotation of the bowl relative to the scraper blade.

8. A centrifuge separation system as in claim 1, wherein said retractable restraining means comprises a frusto-conical bearing surface on said bowl and a frusto-conical guide, said guide being axially movable along an axis of rotation of said bowl to engage said bearing surface during low speed revolutions.

9. A centrifuge separation system as in claim 1, wherein said retractable restraining means is retracted from said bowl during high speed revolutions and said scraper blade is retracted from said interior surface during high speed revolution.

* * * * *